United States Patent [19]

Ball

[11] Patent Number: 4,630,769

[45] Date of Patent: Dec. 23, 1986

[54] DOCUMENT STORAGE CONTAINER

[76] Inventor: Randell D. Ball, 1141 Elk, Yukon, Okla. 73099

[21] Appl. No.: 732,255

[22] Filed: May 8, 1985

[51] Int. Cl.[4] ..... B65D 91/00

[52] U.S. Cl. ..... 232/1 D; 232/19; 232/45

[58] Field of Search ..... 232/1 D, 1 E, 19, 45, 232/46

[56] References Cited

U.S. PATENT DOCUMENTS

| | | | |
|---|---|---|---|
| 475,473 | 5/1892 | Sidman | 232/45 |
| 1,129,382 | 2/1915 | Delonais | 232/45 |
| 1,190,193 | 7/1916 | Rese . | |
| 1,199,136 | 9/1916 | Westphaln . | |
| 1,521,120 | 12/1924 | Murphy | 232/19 |
| 2,370,682 | 3/1945 | Overmyer | 232/45 |
| 2,578,693 | 12/1951 | Gieseler | 232/19 |
| 2,604,260 | 7/1952 | Brown | 232/19 |
| 3,189,265 | 6/1965 | Franklin | 232/19 |
| 3,749,302 | 7/1973 | White | 232/19 |

*Primary Examiner*—Robert P. Swiatek

*Attorney, Agent, or Firm*—Laney, Dougherty, Hessin & Beavers

[57] ABSTRACT

A document storage container for holding documents, such as a run ticket or a swimming pool maintenance record, comprises a receptacle having an open-ended cavity defined therein and a removable lid which can be completely separated from the receptacle. Attached to the lid is a document retaining member, such as a clipboard, against which the document can be retained and which is simultaneously moved into the cavity of the receptacle when the lid is placed on the receptacle to close the open end into the cavity and which is simultaneously moved out of the cavity when the lid is removed from the receptacle to open the open end of the cavity.

11 Claims, 11 Drawing Figures

DOCUMENT STORAGE CONTAINER

BACKGROUND OF THE INVENTION

This invention relates generally to document storage containers and more particularly, but not by way of limitation, to document storage containers for use at remote locations such as a well site or a swimming pool.

At various locations documents need to be retained, such as for holding a receipt or a maintenance record related to some activity at the location. For example, at a well site, there is the need for a container in which a run ticket related to oil gathering can be kept. At a swimming pool, a pool maintenance record containing information about the water treatment needs to be retained. In both of these instances, the container needs to be constructed so that the contents are protected from environmental conditions such as rain and wind.

Such a container should have a sturdy construction to withstand environmental conditions and to stand up to repeated use. It is also desirable that such a container be constructed so that the document is readily inserted into and extracted from the container when the container is closed and opened so that the document can be readily stored and retrieved.

SUMMARY OF THE INVENTION

The present invention meets the aforementioned needs by providing a novel and improved document storage container. The container of the present invention has a sturdy construction which adapts it for use at remote locations such as a well site or a swimming pool. The present invention is also constructed so that the document to be stored is conveniently retained for easy deposit into and withdrawl from the container when the container is closed and opened. The present invention also protects the document when it is retained within the container.

Broadly, the document storage container of the present invention comprises a receptable having an open-ended cavity, lid means for removably closing the open end of the cavity, and document retaining means, connected to the lid means and received within the cavity when the lid means closes the open end of the cavity, for retaining a document so that the document moves into and out of the cavity when the lid means moves onto the receptacle to open the open end of the cavity.

Therefore, from the foregoing, it is a general object of the present invention to provide a novel and improved document storage container. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
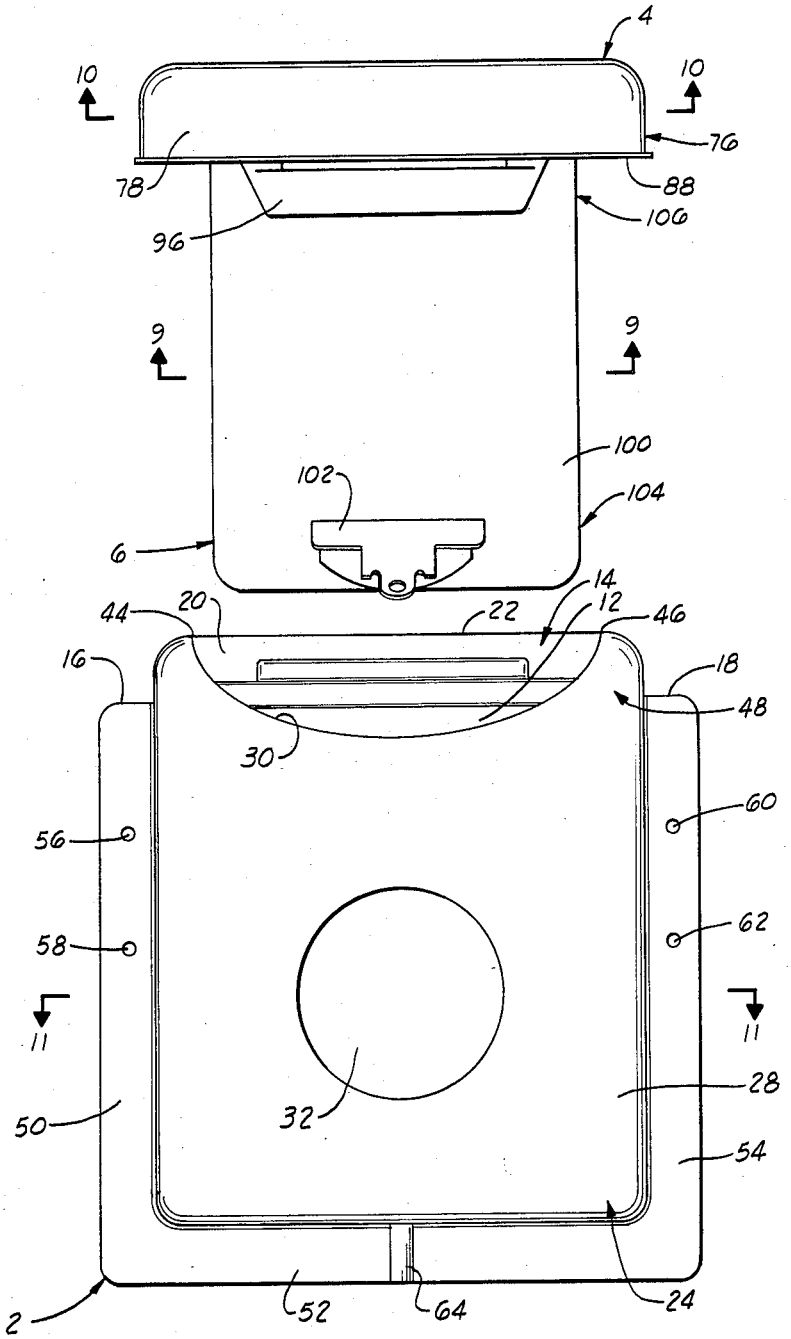
FIG. 1 is a front elevational view of the present invention showing a lid means and document retaining means separated from a receptacle in an open position.
Figure 2:
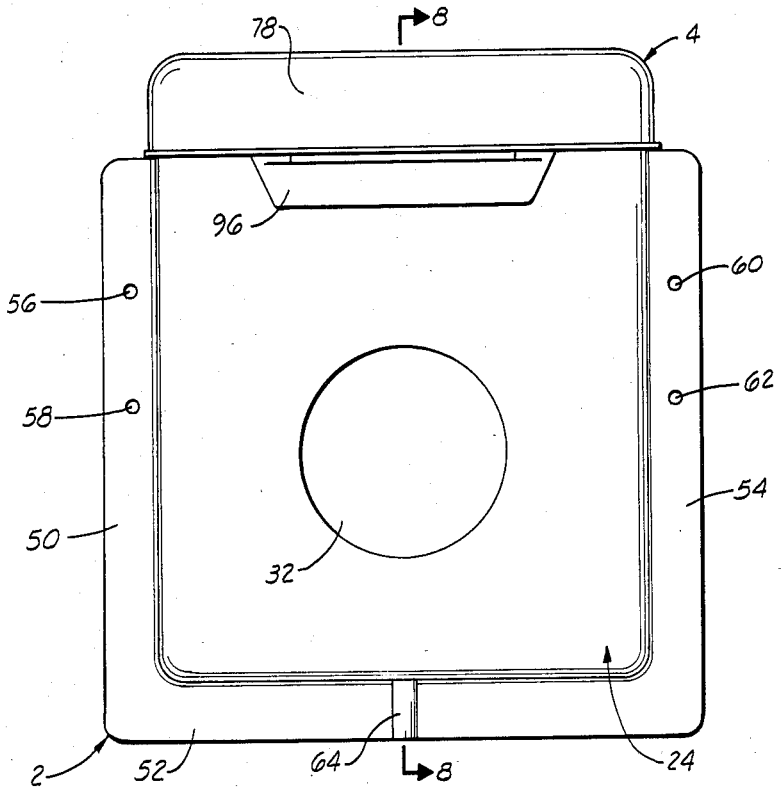
FIG. 2 is a front elevational view of the present invention in a closed position.

With reference to the drawings, a document container constructed in accordance with the preferred embodiment of the present invention will be described. This preferred embodiment is shown in FIG. 1 to include storage means 2, lid means 4, and document retaining means 6. Each of these three general elements will be more particularly described with reference to FIG. 1 and the remaining drawings.

Figure 3:
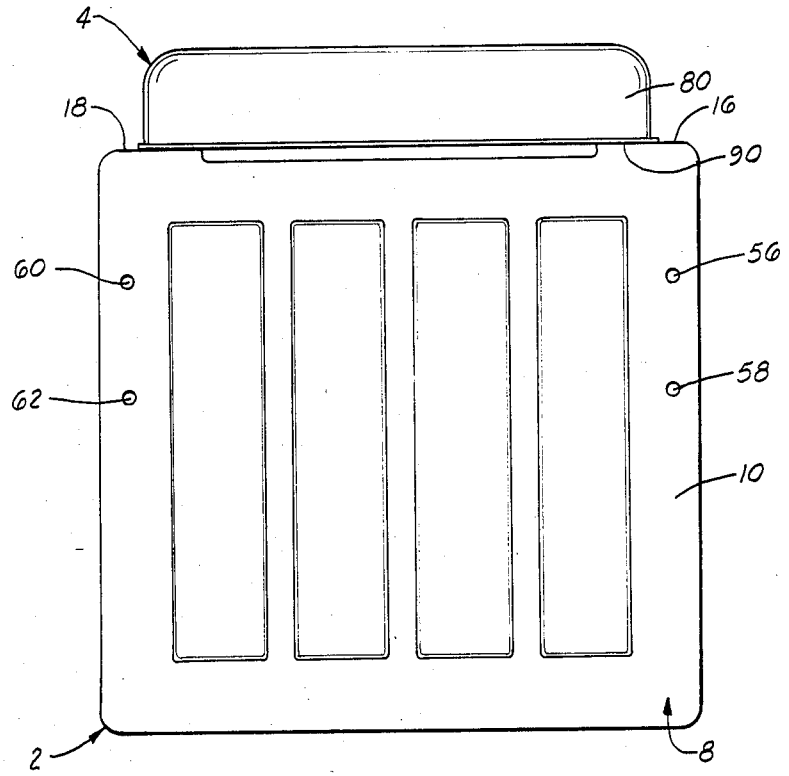
FIG. 3 is a rear elevational view of the present invention in a closed position.
Figure 4:
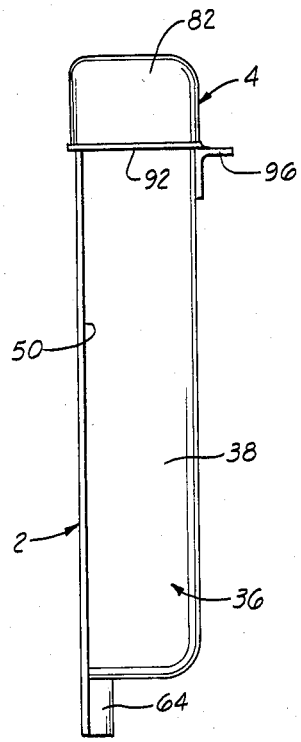
FIG. 4 is a side elevational view of the present invention in a closed position.
Figure 5:
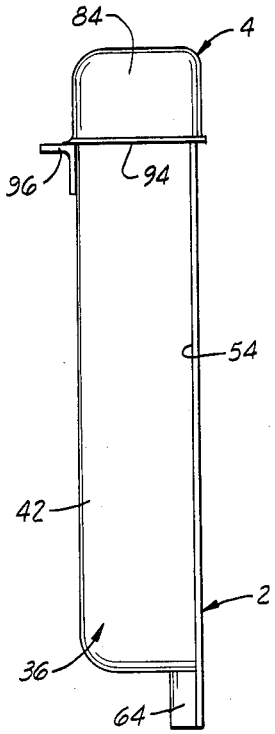
FIG. 5 is an opposite side elevational view showing the present invention in a closed position.
Figure 6:
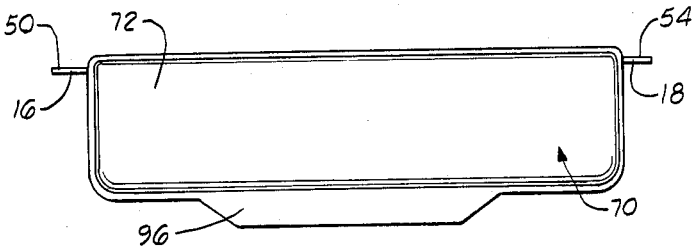
FIG. 6 is a top view of the present invention in a closed position.
Figure 7:
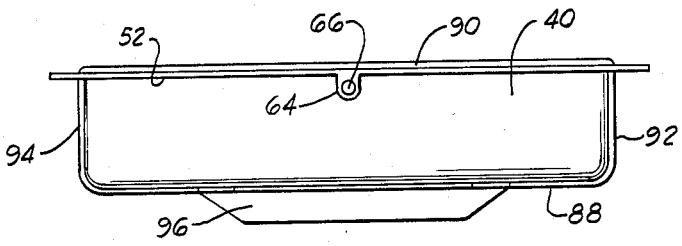
FIG. 7 is a bottom view of the present invention in a closed position.

The storage means 2 is a receptacle having a cavity defined therein into which a document is to be received. The receptacle of the preferred embodiment has a planar back wall 8 having a width defined laterally, or from left to right, as viewed in FIG. 3. The back wall 8 has a height measured vertically or from top to bottom, the fullest extent of which is best viewed in FIGS. 1 and 8. The wall 8 has an outer surface 10 in which indentations are formed in the molding process of the preferred embodiment wherein the wall 8 (as well as the other elements of the storage means 2 and the lid means 4) is made of a suitable molded plastic material. The wall 8 has an inner surface 12 (FIGS. 1 and 8) having an area defining one boundary of the cavity, which cavity is identified by the reference numeral 14. The wall 8 includes a shoulder portion 16 and a shoulder portion 18 from which a tab 20 extends to an edge 22, which edge defines part of an opening into the cavity 14. Both the tab 20 and the remaining primary portion of the wall 8 from which the tab 20 extends have rectangular shapes in the preferred embodiment.

Figure 11:
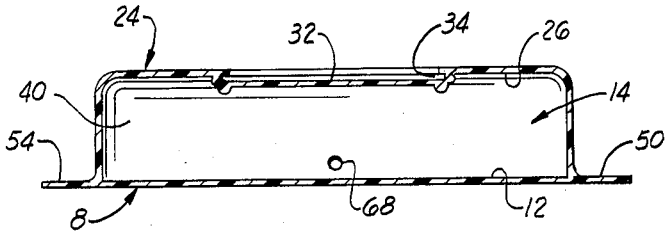
FIG. 11 is a sectional view taken along line 11—11 shown in FIG. 1.

The receptacle also includes a planar front wall 24 spaced from the back wall 8 so that the cavity 14 is defined between the inner surface 12 of the wall 8 and a facing inner surface 26 (FIG. 8) of the wall 24. The wall 24 has an outwardly facing surface 28. The width of the front wall 24 is less than the width of the main portion of the back wall 8, but coextensive with the width of the tab 20. At its upper end, the wall 24 terminates in a curved edge 30 defining another part of the opening into the cavity 14. The edge 30 extends below the edge 22 so that the opening 14 generally faces or opens toward the front of the receptacle. The outer surface 28 of the wall 24 has an indentation 32 defined therein. The indentation 32 is circular in shape in the preferred embodiment and is bounded along its circumference (or more generally its periphery) by a groove 34 (FIGS. 8 and 11) for receiving an edge of an indicia-bearing member disposed in the indentation 32. An example of an indica-bearing member is a label for identifying the nature of the container or its contents.

Joining with the back wall 8 and the front wall 24 is a side wall 36 having three segments 38, 40, 42 (FIGS.

4, 5 and 7) extending along two side edges and a bottom edge of the rectangularly shaped front wall 24 of the preferred embodiment. Each of the segments 38, 40, 42 extends perpendicularly between the walls 8, 24. These segments extend from the respective edges of the front wall 24 to locations on the surface 12 of the back wall 8 spaced inwardly from the outer edges of the wall 8 so that an outer or flange portion of the wall 8 protruding outwardly from the side wall 36 is defined. The side wall 36 defines a periphery of the cavity 14, and it terminates the facing edges 44, 46 defining the remainder of the opening into the cavity 14 and connecting with the edges 22, 30. The upper portions of the segments 38, 42 adjacent the edges 44, 46 and the upper portions of the wall 8 and the wall 24 near the edges 22, 30, respectively, cooperate to define a neck 48 through which the opening into the cavity 14 is defined.

The flange portion, defined between the edges of the primary portion of the back wall 8 below the tab 20 and the intersecting side wall segments 38, 40, 42, has three lengths extending parallel to, but not coextensive with, the lengths of the side wall segments 38, 40, 42. These three lengths, or sections, of the flange portion are identified in the drawings by reference numerals 50, 52, 54. The section 50 has a pair of holes 56, 58 defined therein parallel to and near the segment 38 of the side wall 36. The section 54 has a pair of holes 60, 62 defined therein parallel to and near the segment 42 of the side wall 36. These pairs of holes are horizontally aligned so that holes 56, 60 lie on a horizontal line and so that the holes 58, 62 lie on another horizontal line when the receptacle is positioned as shown in the drawings. Each of the pairs of holes 56, 58 and 60, 62 is constructed for receiving a mounting bracket or bolt of a suitable type (not shown) for mounting the receptacle on a suitable support at a remote site (e.g., a fence rail near a swimming pool or near an oil well). The portions 50, 54 and the associated holes 56, 58, 60, 62 provide a mounting flange extending outwardly from a portion of a closed outer periphery of the rigid pouch defined by the joined back wall 8, front wall 24 and side wall 36, which closed outer periphery is defined in the preferred embodiment by the side wall 36.

The receptacle further includes a spout member 64 having in the preferred embodiment a cylindrical construction through which a channel 66 is defined. The spout member 64 is connected to the section 52 of the outwardly extending flange portion of the receptacle. The member 64 specifically extends perpendicularly to the length of the section 52 and extends from the lower edge of the section 52 to a locus of engagement with the segment 40 of the side wall 36, which segment 40 defines the bottom of the cavity 14. At the point of connection between the segment 40 and the member 64, there is an aperture 68 defined through the segment 40 in communication with the channel 66 so that liquid received in the cavity 14 drains through the aperture 68 and the channel 66. As shown in the drawings, the member 64 is located centrally along the length of the section 52.

In the preferred embodiment, the foregoing elements of the receptacle are integrally molded in a molding process of a type as known to the art. However, other materials and constructions can be used.

The lid means 4 is used for covering (closing) and uncovering (opening) the open end of the cavity 14 in a manner whereby the lid means 4 can be completely removed or separated from the receptacle when the open end is uncovered. The lid means 4 includes a cap defined by a planar top wall 70 having an outer surface 72 and an inner surface 74. Depending along the periphery of the rectangular top wall 70 in a skirt-like fashion is a wall 76 having a front portion 78, a back portion 80, and two end portions 82, 84 with respective outer and inner surfaces. The inner surface 74 and the cooperating inner surfaces of the portions 78, 80, 82, 84 define an interior hollow region 86 for receiving the neck 48 of the receptacle when the lid means 4 is placed on the receptacle to cover the opening into the cavity 14 in the closed position illustrated in FIGS. 2–7, for example. Joined lower terminating edges 88, 90, 92, 94 of the sections 78, 80, 82, 84, respectively, define a mouth into the hollow region through which the neck 48 enters. Depending from the edge 88 is a handle 96.

The lid means 4 also includes a web connected to the cap so that the web extends into the hollow region 86. In the preferred embodiment, the web is defined by a central wall 98 extending perpendicularly from a central portion of the inner surface 74 of the top wall 70 into the hollow region 86. In the preferred embodiment, the central wall 98 is integrally formed with the top wall 70, as is the skirt wall 76.

Figure 8:
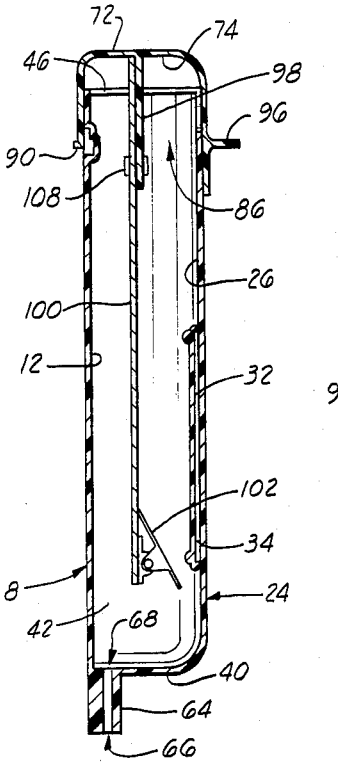
FIG. 8 is a sectional view taken along line 8—8 shown in FIG. 2.
Figure 9:
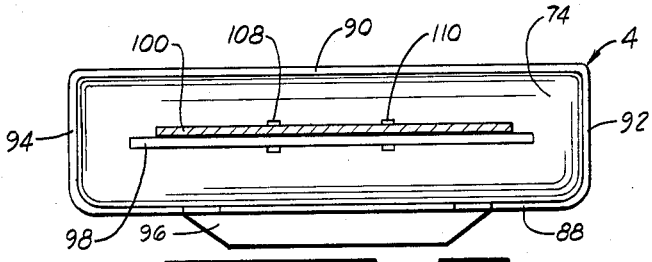
FIG. 9 is a sectional view taken along line 9—9 shown in FIG. 1.
Figure 10:
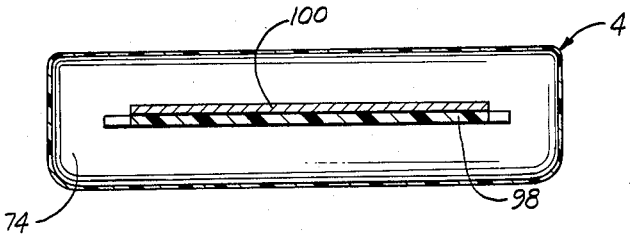
FIG. 10 is a sectional view taken along line 10—10 shown in FIG. 1.

Connected to the central wall 98 in the preferred embodiment is the document retaining means 6. In the preferred embodiment, the document retaining means 6 includes a clipboard having a planar support member 100 and a spring-biased clip member 102 attached to an end portion 104 of the support member 100. The support member 100 has another end portion 106, disposed opposite the end portion 104, attached to and adjacent the central wall 98. In the preferred embodiment, this attachment is by means of rivets 108, 110, which could have washers (not shown) associated therewith adjacent the wall 98 to prevent or impede expansion of the plastic material of which the preferred embodiment wall 98 is made. Other constructions are contemplated, such as integrally forming the support member 100 as a part of the central wall 98. As shown in FIG. 8, the document retaining means 6 extends into and through the hollow region 86 of the lid means 4 so that it is received in the cavity 14 of the storage means 2 when the lid means 4 engages or otherwise receives the neck 48 and covers the open end of the cavity 14.

As shown in FIG. 1, the document retaining means 6 is moved from the cavity 14 and separated from the receptacle simultaneously with the lid means 4 when the lid means 4 is disengaged and removed from the neck 48 to uncover the open end of the cavity 14. In this removed or separated position, the document to be retained within the present invention can be attached to or detached from a position adjacent the support member 100, as held or released by means of the clip member 102. For example, this document could be a run ticket or a swimming pool maintenance log.

To deposit the clipboard in the cavity 14 simultaneously with movement of the lid means 4 to cover the opening into the cavity 14, the end portion 104 is inserted into the cavity 14 through the opening defined by the edges 22, 30, 44, 46, and the lid means 4 is moved downwardly until the neck 48 is fully received in the interior region 86 such as is shown in FIG. 8. In the preferred embodiment this downward, or closing, movement continues until the edges 92, 94 engage shoulders 16, 18, respectively. In this closed position, the cavity 14 and its contents are protected from environmental conditions, such as rain and wind, by the covering or overlying lid means 4 which is biased or counterweighted in its closed position by the document retaining means 6, particularly the clip member 102. However, should any liquid enter the cavity 14, it readily drains through the aperture 68 and the channel 66.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed in the spirit of this invention as defined by the appended claims.

What is claimed is:

1. A document storage container, comprising:

a receptacle having an open-ended cavity defined therein;

lid means for removably closing the open end of said cavity;

document retaining means, connected to said lid means and received within said cavity when said lid means closes the open end of said cavity, for retaining a document so that the document moves into and out of said cavity when said lid means moves onto said receptacle to close the open end of said cavity and off of said receptacle to open the open end of said cavity, wherein said document retaining means includes a clipboard; and wherein said lid means includes:

a cap having an interior hollow region opening through a mouth, said hollow region receiving a portion of said receptacle through said mouth when said lid means closes the open end of said cavity; and a web connected to said cap so that said web extends into said interior hollow region, said web having said clipboard connected thereto.

2. A container as defined in claim 1, wherein said receptacle includes:

a rigid pouch having said cavity and the open end defined therein and having a closed outer periphery extending therearound from one edge of the open end to another edge of the open end; and a mounting flange extending outwardly from said pouch along at least a portion of said closed outer periphery.

3. A container as defined in claim 2, wherein said rigid pouch includes a wall having an outwardly facing surface in which an indentation is defined, said indentation having a peripheral groove for receiving an edge of an indicia-bearing member disposed in said indentation.

4. A document storage container, comprising:

a receptacle having an open-ended cavity defined therein;

lid means for removably closing the open end of said cavity;

document retaining means, connected to said lid means and received within said cavity when said lid means closes the open end of said cavity, for retaining a document so that the document moves into and out of said cavity when said lid means moves onto said receptacle to close the open end of said cavity and off of said receptacle to open the open end of said cavity; and wherein said lid means includes:

a cap having an interior hollow region opening through a mouth, said hollow region receiving a portion of said receptacle through said mouth when said lid means closes the open end of said cavity; and a web connected to said cap so that said web extends into said interior hollow region, said web having said document retaining means connected thereto.

5. A document storage container, comprising:

a receptacle having a cavity into which a document is to be received, said receptacle including:

a planar back wall having a first width;

a planar front wall spaced from said back wall so that said cavity is defined between facing surfaces of said back and front walls, said front wall having a second width less than said first width; and a side wall extending perpendicularly between and joining with said back and front walls so that an outer portion of said back wall protrudes outwardly from said side wall, said side wall defining a periphery of said cavity and said side wall cooperating with said back wall and said front wall to define a neck having an edge defining an opening into said cavity;

a lid, including;

a planar top wall; and a skirt wall depending from said top wall along the periphery thereof so that an interior hollow region is defined by inner surfaces of said top wall and said skirt wall, said hollow region receiving said neck of said receptacle when said lid is placed on said receptacle to cover said opening into said cavity; and document retaining means for retaining the document thereagainst, said document retaining means connected to said lid and extending from said hollow region below a terminating edge of said skirt wall opposite said top wall so that said document retaining means is received in said cavity when said lid engages said neck and so that said document retaining means is removed from said cavity and separated from said receptacle when said lid is disengaged and moved from said neck.

6. A container as defined in claim 5, wherein said lid further includes a central wall extending from a central portion of the inner surface of said top wall into said hollow region, said support wall having said document retaining means connected thereto.

7. A container as defined in claim 6, wherein said document retaining means includes a clipboard having a support member and a clip member attached to one end of said support member, said support member having another end, opposite said one end, attached to and adjacent said central wall.

8. A container as defined in claim 7, wherein said front wall includes an outer surface having an indentation defined therein for receiving a label.

9. A container as defined in claim 8, wherein said receptacle further includes a spout member disposed on said outer portion of said back wall adjacent a portion of said side wall defining a bottom of said cavity, said spout member having a channel defined therethrough and said portion of said side wall having an aperture defined therethrough in communication with said channel so that liquid received in said cavity drains through said aperture and said channel.

10. A container as defined in claim 9, wherein:

said front wall has a rectangular shape;

said side wall extends in three respective segments along two side edges and a bottom edge of said front wall; and said outer portion of said back wall extends along the three respective segments of said side wall but not coextensive therewith, said outer portion having a first pair of holes defined therein parallel to and near a first one of the segments of said side wall and having a second pair of holes defined therein parallel to and near a second one of the segments of said side wall, said first pair of holes horizontally aligned with said second pair of holes.

11. A container as defined in claim 10, wherein said spout member includes a cylindrical body extending perpendicularly to the length of said outer portion extending along a third one of the three segments of said side wall.

* * * * *

UNITED STATES PATENT AND TRADEMARK OFFICE

CERTIFICATE OF CORRECTION

PATENT NO. : 4,630,769

DATED : December 23, 1986

INVENTOR(S) : Randell D. Ball

It is certified that error appears in the above-identified patent and that said Letters Patent are hereby corrected as shown below:

Column 1, line 49, after "to" insert --close the open end of the cavity and off of the receptacle to--; and Column 3, line 11, change the first occurrence of the word "the" to --in--.

Signed and Sealed this

Twenty-fourth Day of March, 1987

*Attest:*

DONALD J. QUIGG

*Attesting Officer*

*Commissioner of Patents and Trademarks*